US010218055B2

(12) United States Patent
Tseng et al.

(10) Patent No.: US 10,218,055 B2
(45) Date of Patent: Feb. 26, 2019

(54) ANTENNA

(71) Applicant: Wistron NeWeb Corp., Hsinchu (TW)

(72) Inventors: Shih-Hsien Tseng, Hsinchu (TW); Chih-Ming Wang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 148 days.

(21) Appl. No.: 15/262,531

(22) Filed: Sep. 12, 2016

(65) Prior Publication Data

US 2017/0271747 A1 Sep. 21, 2017

(30) Foreign Application Priority Data

Mar. 18, 2016 (TW) ..... 105108418 A

(51) Int. Cl.
*H01Q 1/24* (2006.01)
*H01Q 13/08* (2006.01)

(52) U.S. Cl.
CPC ..... *H01Q 1/243* (2013.01); *H01Q 13/085* (2013.01)

(58) Field of Classification Search
CPC ..... H01Q 1/24; H01Q 1/241; H01Q 1/242; H01Q 1/243; H01Q 5/30; H01Q 5/307; H01Q 5/314; H01Q 5/321; H01Q 5/357; H01Q 5/378; H01Q 5/40; H01Q 13/085; H01Q 13/10; H01Q 13/103
See application file for complete search history.

(56) References Cited

U.S. PATENT DOCUMENTS

| | | | | |
|---|---|---|---|---|
| 6,765,538 | B2 * | 7/2004 | Fang | H01Q 13/10 343/702 |
| 9,099,790 | B2 * | 8/2015 | Chen | H01Q 1/243 |
| 9,502,775 | B1 * | 11/2016 | Gummalla | H01Q 13/10 |
| 9,627,769 | B2 * | 4/2017 | Koo | H01Q 5/335 |
| 2014/0125528 | A1 * | 5/2014 | Tsai | H01Q 1/243 343/702 |
| 2015/0002351 | A1 * | 1/2015 | Jeong | H01Q 13/103 343/750 |

* cited by examiner

*Primary Examiner* — Tho G Phan
*Assistant Examiner* — Patrick R Holecek
(74) *Attorney, Agent, or Firm* — McClure, Qualey & Rodack, LLP

(57) ABSTRACT

An antenna is provided adapted to be formed on a metal housing of an electronic device. The antenna includes a first slot, a second slot, a substrate, a feed conductor and a signal source. The first slot and the second slot are formed on the metal housing. The first slot and the second slot are aligned along an axis. The substrate is disposed on the metal housing. The feed conductor is disposed on the substrate and corresponding to the first slot. The feed conductor includes a first section and a second section, the first section is extended in a first direction, the first slot is extended in the first direction toward the second slot, the second section extends in a second direction, and the second slot extends in the second direction toward the first slot. The signal source is electrically connected to the feed conductor.

5 Claims, 8 Drawing Sheets

ANTENNA

CROSS REFERENCE TO RELATED APPLICATIONS

This Application claims priority of Taiwan Patent Application No. 105108418, filed on Mar. 18, 2016 , the entirety of which is incorporated by reference herein.

BACKGROUND OF THE INVENTION

Field of the Invention

The present invention relates to an antenna, and in particular to an antenna utilized in an electronic device with a metal housing.

Description of the Related Art

Notebook and tablet computers with metal housings are increasingly common. However, conventional antennas cannot provide quality transmission under the shielding of the metal housing. Additionally, in the conventional antenna design, the impedance matching of the antenna cannot be adjusted. In particular, the imaginary impedance of the conventional antenna cannot be offset. Therefore, the effective bandwidth of the conventional antenna is insufficient.

BRIEF SUMMARY OF THE INVENTION

In one embodiment, an antenna is provided. The antenna is adapted to be formed on a metal housing of an electronic device. The antenna includes a first slot, a second slot, a substrate, a feed conductor, a signal source, a first coupling sheet and a frequency adjustment element. The first slot is formed on the metal housing, capable of transmitting a low-band signal. The second slot is formed on the metal housing, capable of transmitting a high-band signal, wherein the first slot and the second slot are aligned along an axis. The substrate is disposed on the metal housing. The feed conductor is disposed on the substrate and crossing the first slot, wherein the feed conductor is capable of feeding signal via coupling. The signal source is electrically connected to the feed conductor. The first coupling sheet is disposed on the substrate and connected to the feed conductor, wherein the first coupling sheet is extended in a first direction parallel to the axis, and the first slot is extended in the first direction toward the second slot. The frequency adjustment element crosses the first slot, wherein the feed conductor is located between the second slot and the frequency adjustment element.

In one embodiment, the first slot has a first part and a second part divided by a center of a longitudinal axis of the first slot, the first part is located between the second part and the second slot, and the feed conductor is located in the first part.

In one embodiment, the frequency adjustment element is located in the second part.

In one embodiment, a metal wall is formed on the metal housing, and the metal wall separates and defines the first slot and the second slot.

In one embodiment, a frequency defining element is disposed on the substrate, two ends of the frequency defining element are respectively disposed across the slots and are adjacent to the substrate to separate and define the first slot and the second slot.

In one embodiment, the frequency adjustment element is disposed on the substrate.

In one embodiment, the first coupling sheet does not overlap with the first slot on a projection plane.

In one embodiment, the antenna further includes a second coupling sheet, disposed on the substrate and connected to the feed conductor, wherein the second coupling sheet is extended in a second direction, the first direction is opposite to the second direction, and the second slot is extended in the second direction and toward the first slot.

In one embodiment, the second coupling sheet and the first coupling sheet are located on the same straight line, and the second coupling sheet does not overlap with the first slot on the projection plane.

In one embodiment, another antenna is provided. The antenna is adapted to be formed on a metal housing of an electronic device. The antenna includes a first slot, a second slot, a substrate, a feed conductor and a signal source. The first slot is formed on the metal housing, capable of transmitting a low-band signal. The second slot is formed on the metal housing, capable of transmitting a high-band signal, wherein the first slot and the second slot are aligned along an axis. The substrate is disposed on the metal housing. The feed conductor is disposed on the substrate and corresponding to the first slot, wherein the feed conductor is capable of feeding signal via coupling, the feed conductor is longitudinal, the feed conductor comprises a first section and a second section, the first section is extended in a first direction parallel to the axis, the first slot is extended in the first direction toward the second slot, the second section extends in a second direction, the second direction is opposite to the first direction, and the second slot extends in the second direction toward the first slot. The signal source is electrically connected to the feed conductor.

In one embodiment, the feed conductor overlaps the first slot on a projection plane.

In one embodiment, the first slot has a first part and a second part divided by the center of a longitudinal axis of the first slot, the first part is located between the second part and the second slot, and the feed conductor is located in the second part.

In one embodiment, the first slot comprises a first end and a second end, the first end is located between the second end and the second slot, and a distance between the feed conductor and the second end is greater than one-twelfth of a wavelength of a central frequency of the high-band signal.

In one embodiment, a metal wall is formed on the metal housing, and the metal wall separates and defines the first slot and the second slot.

In one embodiment, a frequency defining element is disposed on the substrate to separate and define the first slot and the second slot.

Utilizing the antenna of the first embodiments of the invention, the antenna provides quality transmission within the electronic device with the metal housing. In particular, the imaginary impedance of the antenna can be modified to provide sufficient effective bandwidth.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
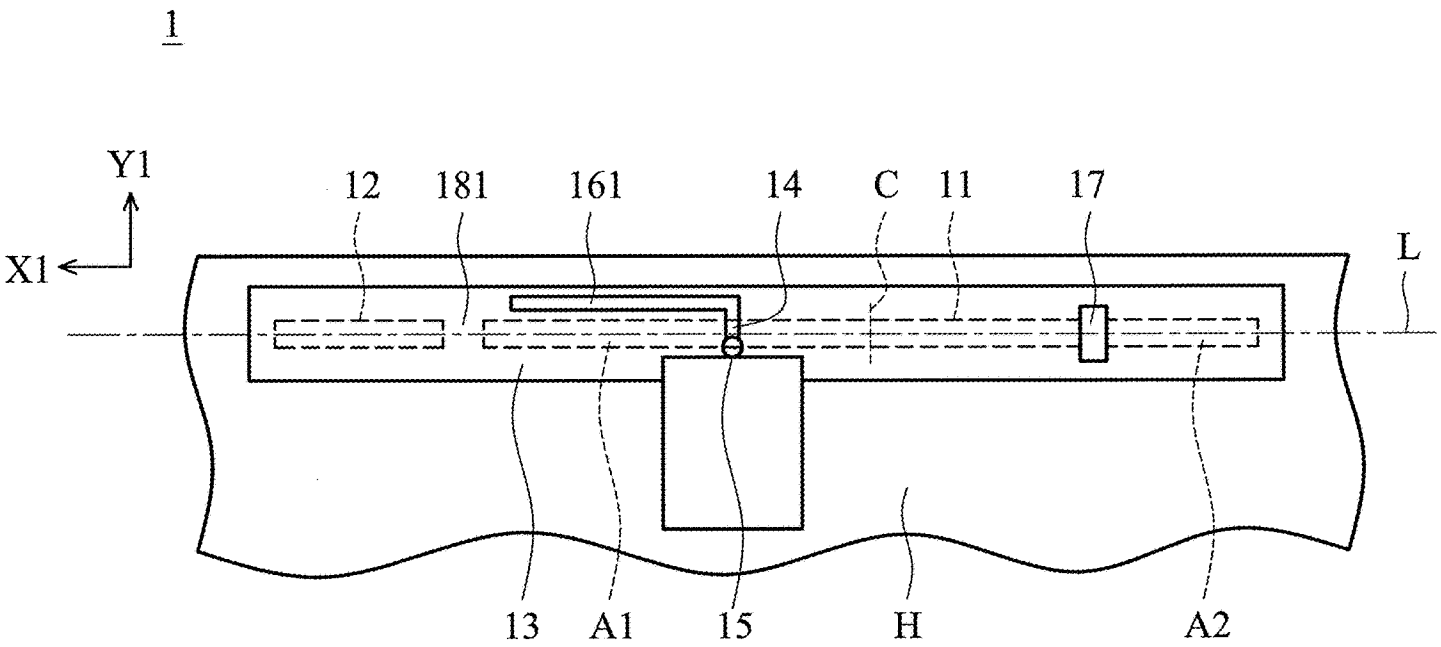
FIG. 1 shows an antenna of a first embodiment of the invention.

The antenna of the embodiment of the invention is adapted to be formed on a metal housing of an electronic device (for example a tablet, notebook, or mobile phone), in one embodiment, the metal housing is an outer housing substantially covering all electronic elements of the electronic device. FIG. 1 shows an antenna of a first embodiment of the invention. The antenna 1 includes a first slot 11, a second slot 12, a substrate 13, a feed conductor 14, a signal source 15, a first coupling sheet 161, and a frequency adjustment element 17. The first slot 11 is formed on the metal housing H, adapted to transmit a low-band signal. The second slot 12 is formed on the metal housing H, adapted to transmit a high-band signal. The first slot 11 and the second slot 12 are located on the same axis L.

With reference to FIG. 1, the substrate 13 is disposed on the metal housing H. In one embodiment, the substrate 13 includes dielectric material, such as a substrate of a circuit board.

With reference to FIG. 1, the feed conductor 14 is disposed on the substrate 13 and crosses the first slot 11, in which the feed conductor 14 is used to feed signals to the antenna by coupling. Crossing the first slot 11 means two ends of the feed conductor 14 being respectively located on both sides of the first slot. In other words, the first slot 11 overlaps the feed conductor 14 on a projection plane. In this embodiment, the feed conductor 14 is extended perpendicular to the axis L. However, this embodiment is not meant to restrict the invention. The signal source 15 is electrically connected to the feed conductor 14. The first coupling sheet 161 is disposed on the substrate 13 and connected to the feed conductor 14. The first coupling sheet 161 is extended in a first direction X1. The first direction X1 is parallel to the axis L. The first slot 11 extends in the first direction X1 toward the second slot 12. The frequency adjustment element 17 crosses the first slot 11, wherein the feed conductor 14 is located between the second slot 12 and the frequency adjustment element 17. In this embodiment, the frequency adjustment element 17 is disposed on the substrate 13.

With reference to FIG. 1, in one embodiment, the first slot 11 has a first part A1 and a second part A2 divided by a center C of a longitudinal axis of the first slot 11. The first part A1 is located between the second part A2 and the second slot 12. The feed conductor 14 is located in the first part A1. The frequency adjustment element 17 is located in the second part A2.

With reference to FIG. 1, in one embodiment, a metal wall 181 is formed on the metal housing H, and the metal wall 181 separates and defines the first slot 11 and the second slot 12.

Figure 2:
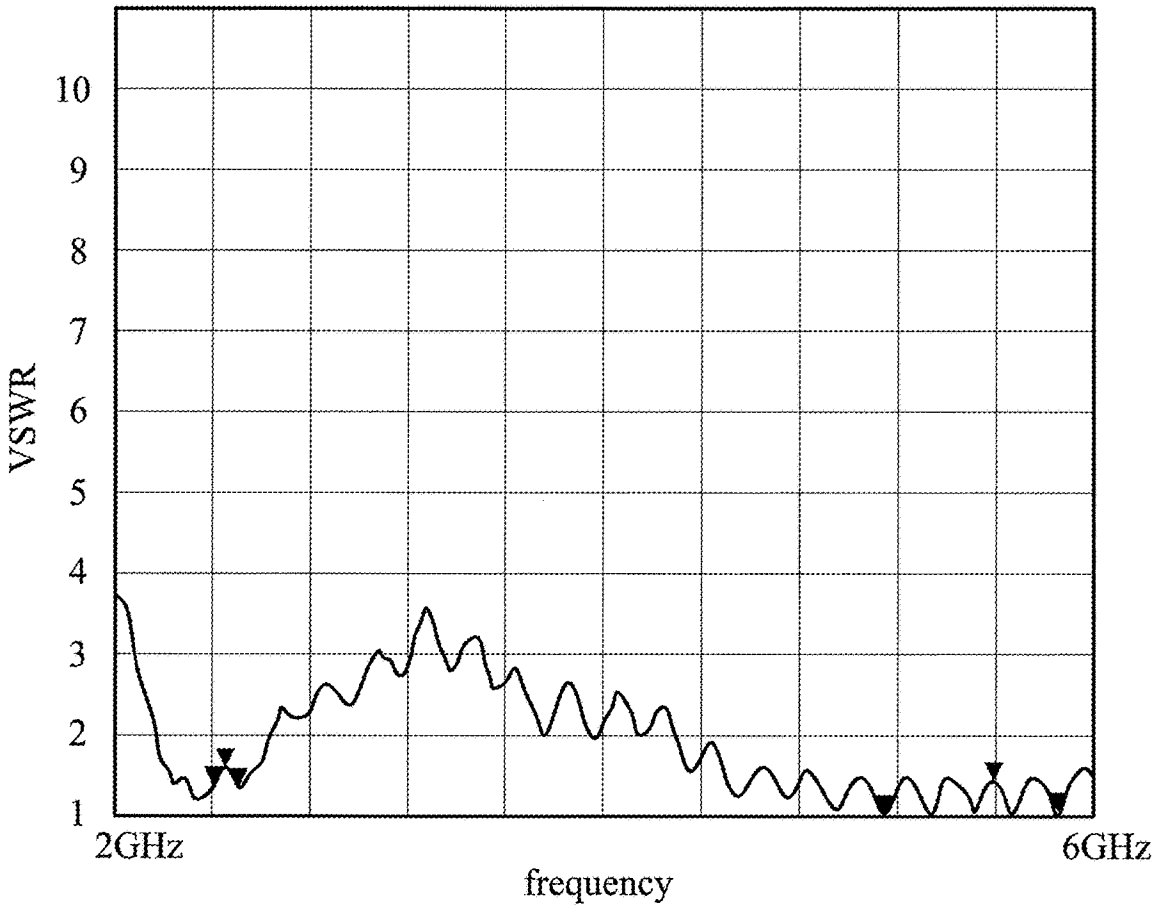
FIG. 2 shows the voltage standing wave ratio of the first embodiment of the invention.
Figure 3:
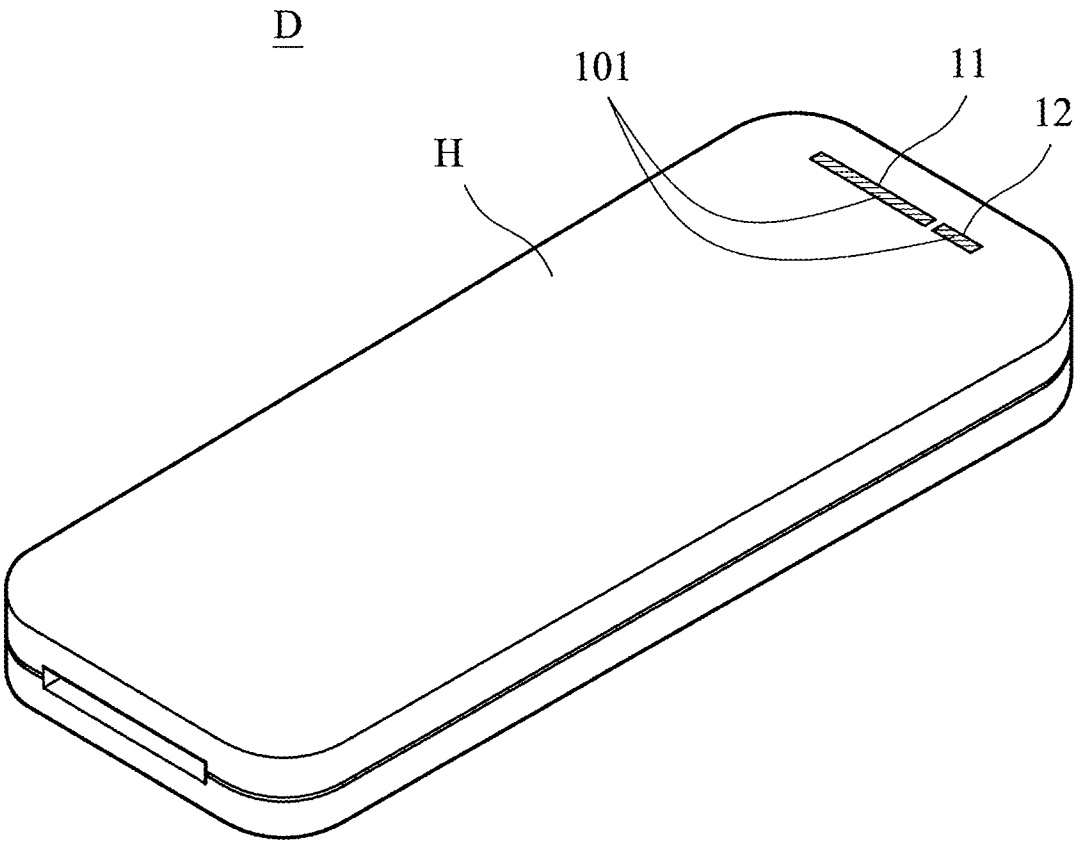
FIG. 3 shows an electronic device of an embodiment of the invention.

In this embodiment, the first coupling sheet does not overlap with the first slot 11 on the projection plane (X1-Y1 plane). The low-band signal is transmitted by the resonance of the first slot 11, where the length of the first slot 11 substantially equals half of the wavelength of the low-band signal. The high-band signal is transmitted by the resonance of the second slot 12, where the length of the second slot 12 substantially equals quarter of the wavelength of the high-band signal. The signal source 15 induces the low-band signal and the high-band signal through the feed conductor 14 to the first slot 11 and the second slot 12. In particular, the first slot 11 and the second slot are resonated to provide the dual-band transmission. The first coupling sheet 161 is utilized to adjust the impedance matching and the bandwidth including the imaginary impedance. According to this particular embodiment, the imaginary impedance of the low-band signal may be adjusted and improved by the first coupling sheet 161. By changing the position of the frequency adjustment element 17 along the axis L, the central frequency of the low-band signal can be adjusted. With reference to FIG. 2, although the antenna is disposed in an electronic device housed by metal, the antenna of the aforementioned first embodiment still offers signal transmission with good quality. FIG. 3 shows an electronic device D utilizing the antenna of the embodiment of the present invention. The first slot 11 and the second slot 12 can be seen on an outer surface of the metal housing H. In one embodiment, a filler material can be filled in the first slot 11 and the second slot 12 to improve outward appearance.

Figure 4:
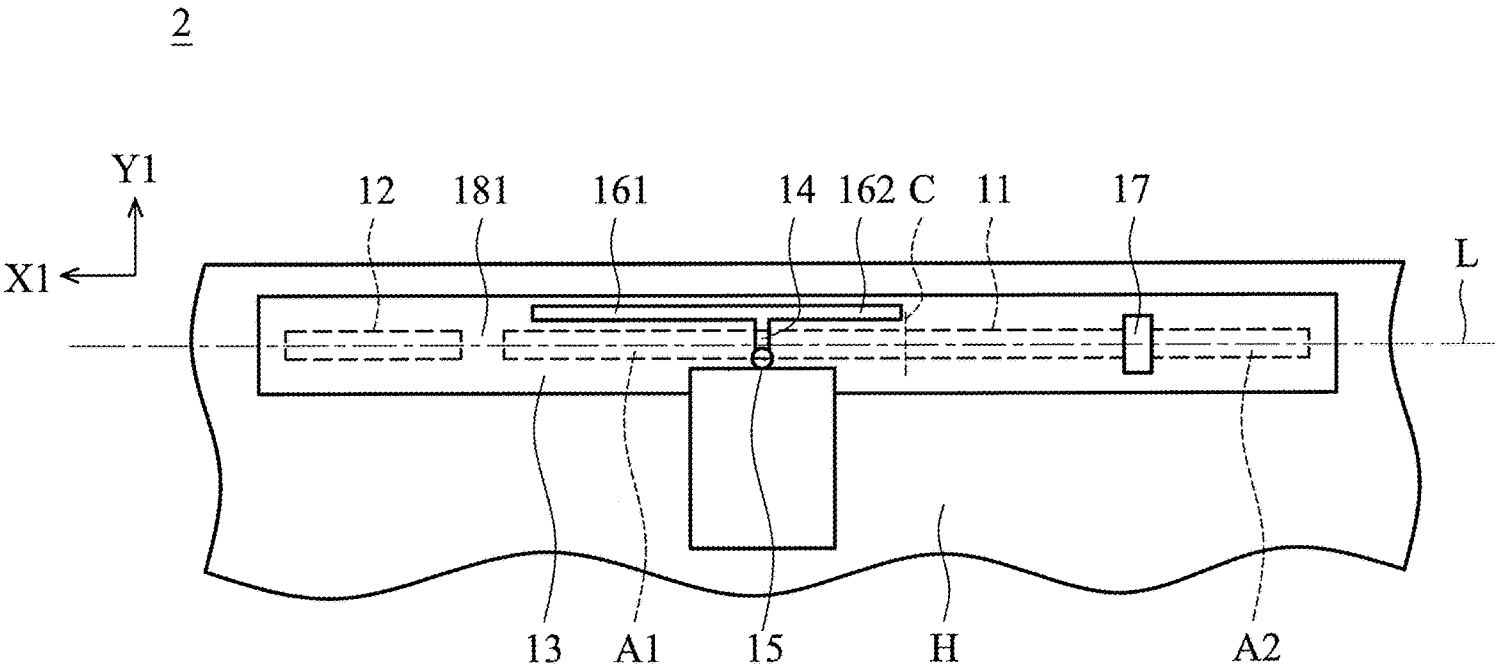
FIG. 4 shows an antenna of a second embodiment of the invention.

FIG. 4 shows an antenna 2 of a second embodiment of the invention. The antenna 2 further includes a second coupling sheet 162 disposed on the substrate 13 and connected to the feed conductor 14. The second coupling sheet 162 extends in a second direction −X1. The first direction X1 is opposite to the second direction −X1. The second slot 12 extends in the second direction −X1 toward the first slot 11. In this embodiment, the second coupling sheet 162 and the first coupling sheet 161 are located on the same straight line, and the second coupling sheet 162 does not overlap with the first slot 11 on the projection plane (X1-Y1 plane). In this embodiment, the first coupling sheet 161 and the second coupling sheet 162 are utilized to adjust the impedance matching and the bandwidth including the imaginary impedance. According to this particular embodiment, the imaginary impedance of the low-band signal may be adjusted and improved by the first coupling sheet 161, whereas the imaginary impedance of the high-band signal may be adjusted and improved by the second coupling sheet 162.

Figure 5:
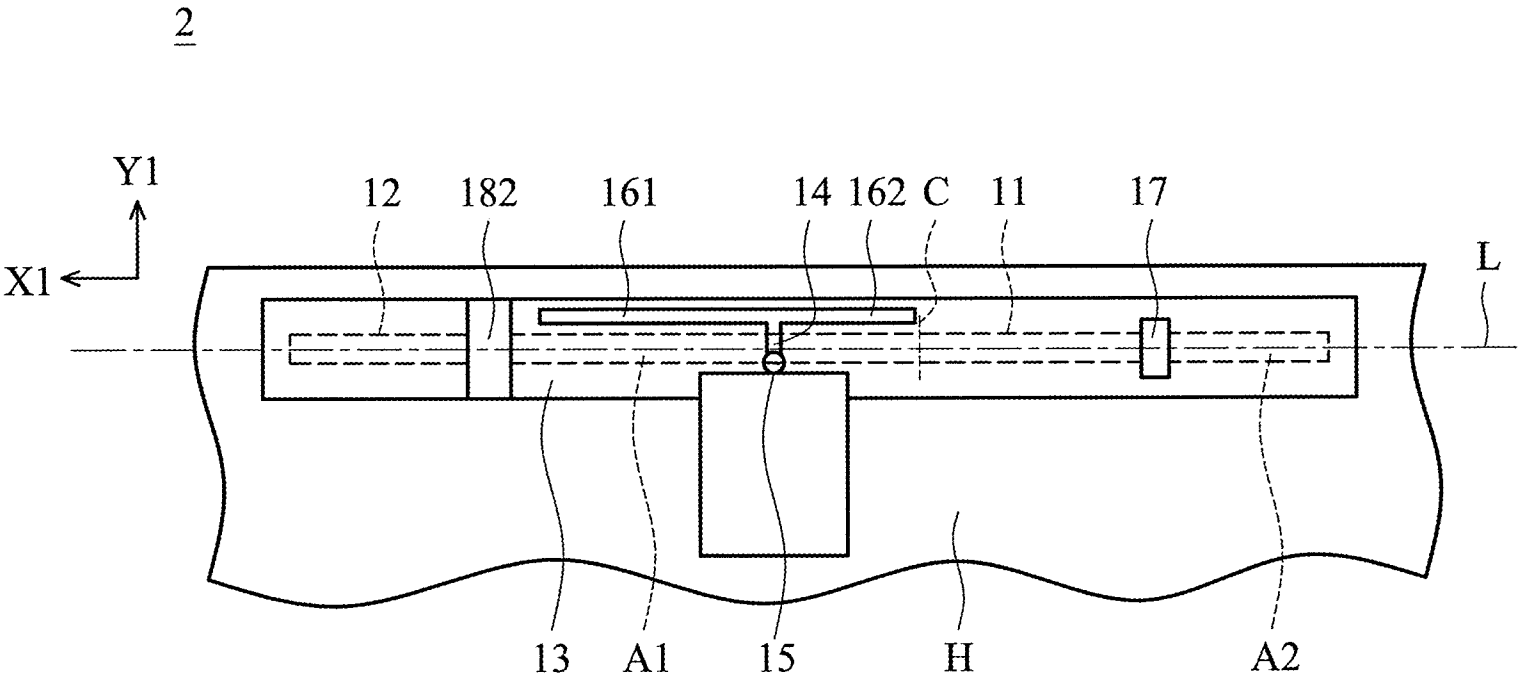
FIG. 5 shows an antenna of a third embodiment of the invention.

FIG. 5 shows an antenna 3 of a third embodiment of the invention with the metal wall 181 removed. The first slot 11 is physically communicated with the second slot 12. A frequency defining element 182 is disposed on the substrate 13. Two ends of the frequency defining element 182 cross the slots (the first slot 11 and the second slot 12), which means that the two ends of the frequency defining element 182 are respectively disposed at the both sides of the slots 11 and 12. The two ends are adjacent to the substrate 13, so the frequency defining element 182 can be capable of separating and defining the first slot 11 and the second slot 12 during signal transmission. In this embodiment, the frequency defining element 182 replaces the metal wall 181 and provides the same function as the metal wall 181 does by coupling, and the antenna 3 still operates in a good transmission quality.

Figure 6:
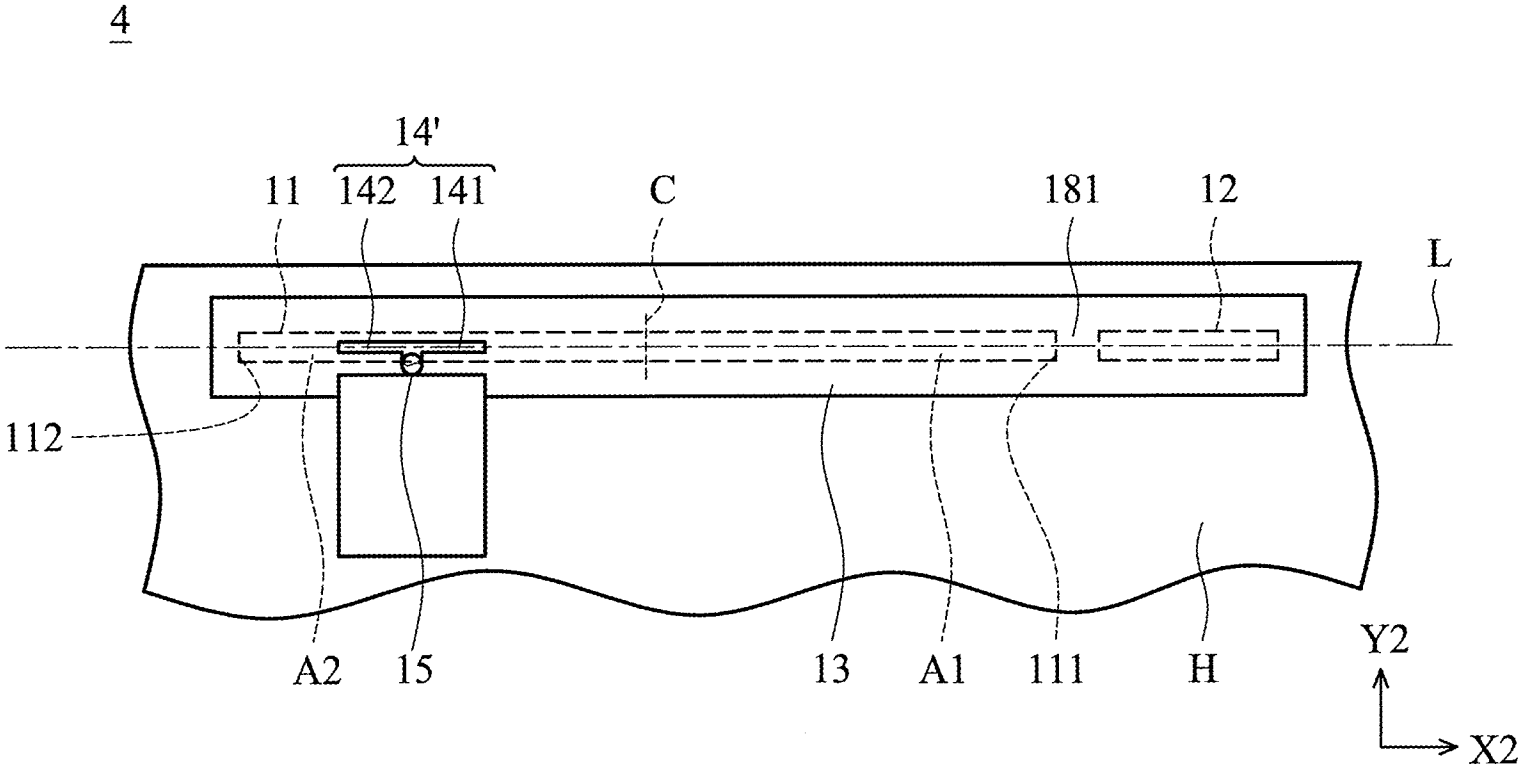
FIG. 6 shows an antenna of a fourth embodiment of the invention.

FIG. 6 shows an antenna 4 of a fourth embodiment of the invention. The antenna 4 includes a first slot 11, a second slot 12, a substrate 13, a feed conductor 14' and a signal source 15. The first slot 11 is formed on the metal housing H capable of transmitting a low-band signal. The second slot 12 is formed on the metal housing H capable of transmitting a high-band signal. The first slot 11 and the second slot 12 are located on the same axis L. The substrate 13 is disposed on the metal housing H. The feed conductor 14' is disposed on the substrate 13 and corresponding to the first slot 11. The feed conductor 14' feeds a signal to the antenna by coupling. The feed conductor 14' is longitudinal. The feed conductor 14' includes a first section 141 and a second section 142. The first section 141 is extended in a first direction X2. The first direction X2 is parallel to the axis L. The first slot 11 is extended in the first direction X2 toward the second slot 12. The second section 142 is extended in a second direction −X2. The second direction −X2 is opposite to the first direction X2. The second slot 12 is extended in the second direction −X2 toward the first slot 11. The signal source 15 is electrically connected to the feed conductor 14'.

With reference to FIG. 6, in this embodiment, the feed conductor 14' overlaps the first slot 11 on a projection plane (X2-Y2 plane). The first slot 11 has a first part A1 and a second part A2 divided by a center C of a longitudinal axis of the first slot 11. The first part A1 is located between the second part A2 and the second slot 12. The feed conductor 14' is located in the second part A2. In this embodiment, the first slot 11 has a first end 111 and a second end 112. The first end 111 is located between the second end 112 and the second slot 12. The distance between the feed conductor 14' and the second end 112 is greater than one-twelfth of the wavelength of the central frequency of the high-band signal. In this embodiment, a metal wall 181 is formed on the metal housing H, and the metal wall 181 separates and defines the first slot 11 and the second slot 12.

Figure 7:
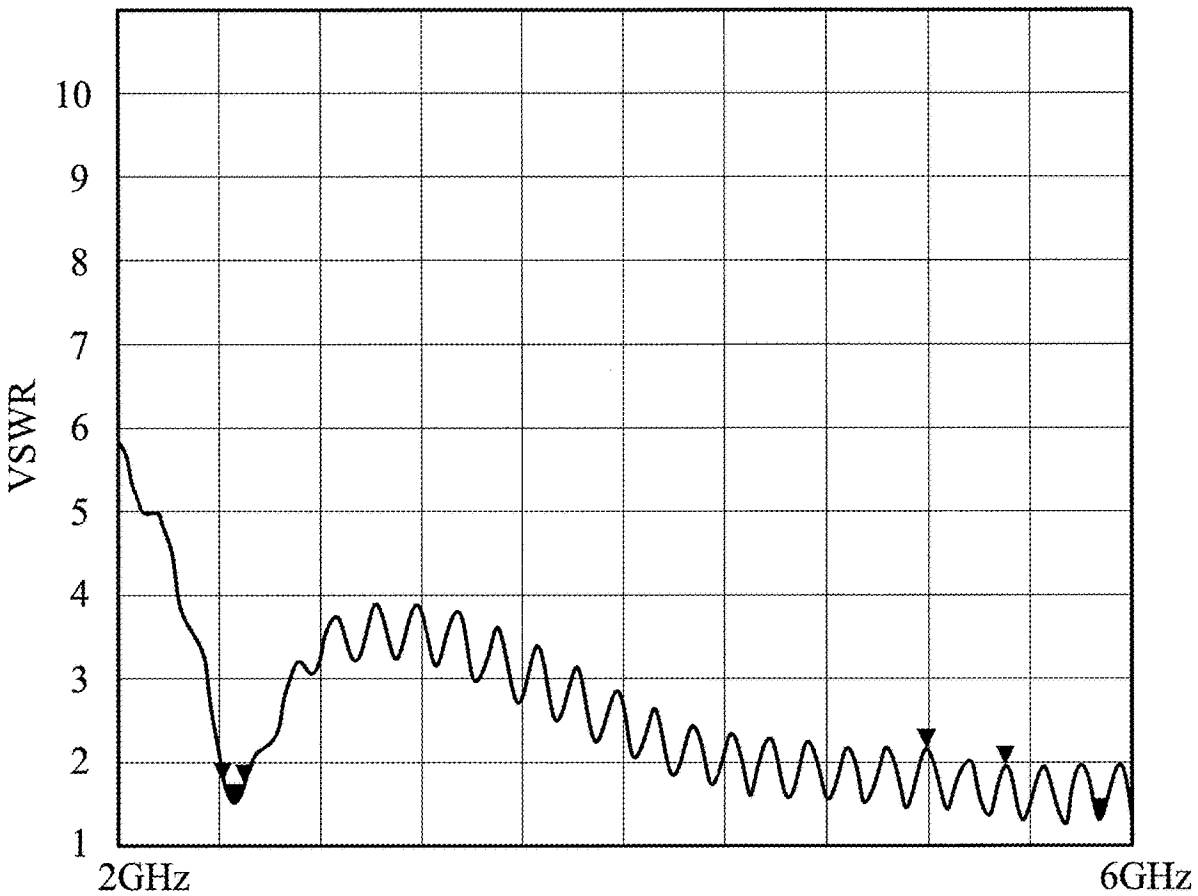
FIG. 7 shows the voltage standing wave ratio of the fourth embodiment of the invention.

In this embodiment, the low-band signal is transmitted by the resonance of the first slot 11, in which the length of the first slot 11 substantially equals half of the wavelength of the low-band signal. The high-band signal is transmitted by the resonance of the second slot 12, in which the length of the second slot 12 substantially equals the quarter wavelength of the high-band signal. The signal source 15 induces the low-band signal and the high-band signal through the feed conductor 14', the first slot 11 and the second slot 12. In particular, the first slot 11 and the second slot are resonated to provide the dual-band transmission. The shape of the feed conductor 14' and a vertical distance between the feed conductor 14' and the first slot 11 can be utilized to modify the impedance matching and the bandwidth. With reference to FIG. 7, utilizing the antenna of the fourth embodiment of the invention, the antenna provides quality transmission within the electronic device with the metal housing.

Figure 8:
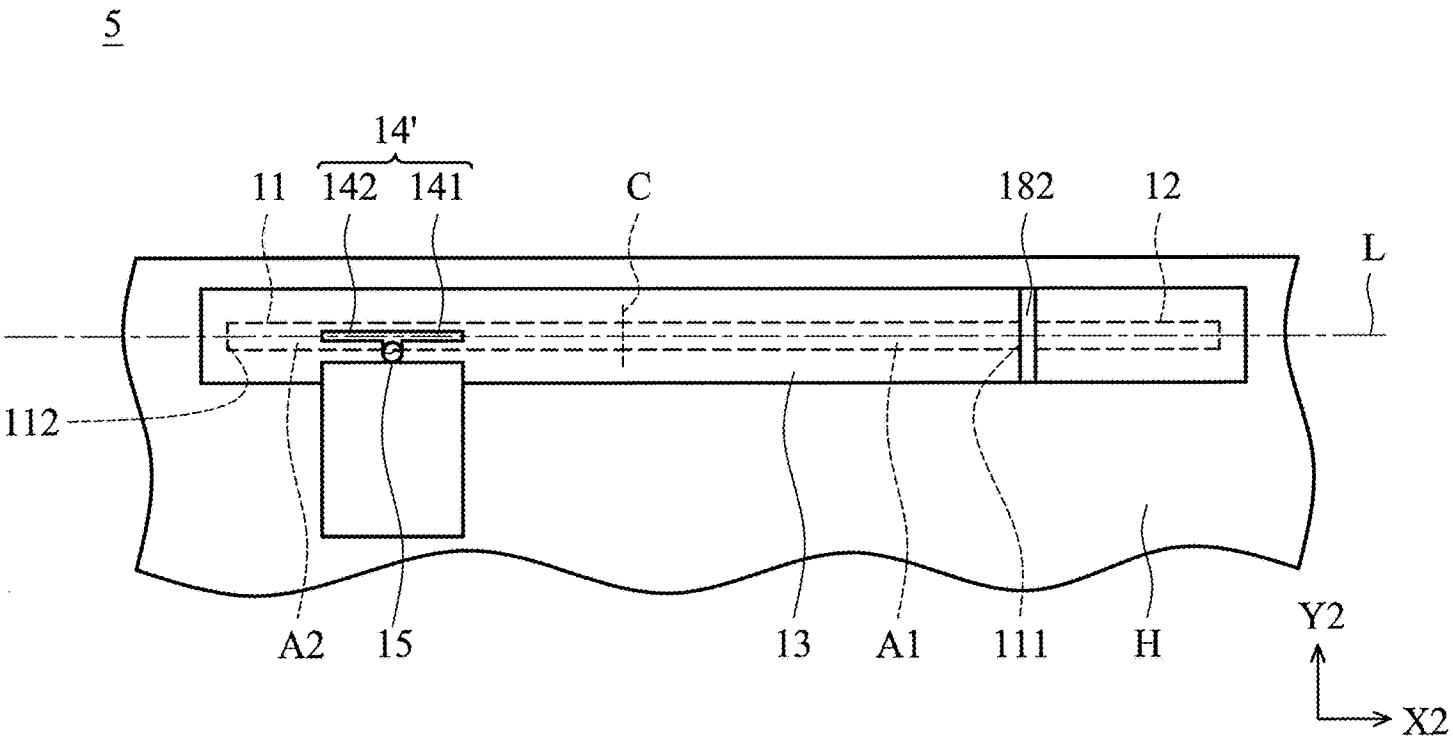
FIG. 8 shows an antenna of a fifth embodiment of the invention.

FIG. 8 shows an antenna 5 of a fifth embodiment of the invention with the metal wall 181 removed. The first slot 11 is physically communicated with the second slot 12. A frequency defining element 182 is disposed on the substrate 13. Two ends of the frequency defining element 182 cross the slots (the first slot 11 and the second slot 12), which means that the two ends of the frequency defining element 182 are respectively disposed at the both sides of the slots 11 and 12. The two ends are adjacent to the substrate 13, so the frequency defining element 182 can be capable of separating and defining the first slot 11 and the second slot 12 during signal transmission. In this embodiment, the frequency defining element 182 replaces the metal wall 181 and provides the same function as the metal wall 181 does by coupling, and the antenna 3 still operates in a good transmission quality.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna, adapted to be formed on a metal housing of an electronic device, comprising:

a first slot, formed on the metal housing, capable of transmitting a low-band signal;

a second slot, formed on the metal housing, capable of transmitting a high-band signal, wherein the first slot and the second slot are aligned along an axis;

a substrate, disposed on the metal housing;

a feed conductor, disposed on the substrate and corresponding to the first slot, wherein the feed conductor is capable of feeding signal via coupling, the feed conductor is longitudinal, the feed conductor comprises a first section and a second section, the first section is extended in a first direction parallel to the axis, the first slot is extended in the first direction toward the second slot, the second section extends in a second direction, the second direction is opposite to the first direction, and the second slot extends in the second direction toward the first slot; and a signal source, electrically connected to the feed conductor, wherein the first section and the second section of the feed conductor are in the first slot on a projection plane.

2. The antenna as claimed in claim 1, wherein the first slot has a first part and a second part divided by the center of a longitudinal axis of the first slot, the first part is located between the second part and the second slot, and the feed conductor is located in the second part.

3. The antenna as claimed in claim 2, wherein the first slot comprises a first end and a second end, the first end is located between the second end and the second slot, and a distance between the feed conductor and the second end is greater than one-twelfth of a wavelength of a central frequency of the high-band signal.

4. The antenna as claimed in claim 1, wherein a metal wall is formed on the metal housing, and the metal wall separates and defines the first slot and the second slot.

5. The antenna as claimed in claim 1, wherein a frequency defining element is disposed on the substrate to separate and define the first slot and the second slot.

* * * * *